US006444938B1

(12) United States Patent
Erk et al.

(10) Patent No.: US 6,444,938 B1
(45) Date of Patent: Sep. 3, 2002

(54) SWITCHGEAR WITH SWITCHING DEVICES ARRANGED IN HOUSINGS

(75) Inventors: Thomas Erk, Senzig; Hartmut Schoentag, Hohen; Andreas Stelzer; Reinhard Zeuke, both of Berlin, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/807,815

(22) PCT Filed: Oct. 12, 1999

(86) PCT No.: PCT/DE99/03308

§ 371 (c)(1),
(2), (4) Date: Apr. 19, 2001

(87) PCT Pub. No.: WO00/25333

PCT Pub. Date: May 4, 2000

(30) Foreign Application Priority Data

Oct. 23, 1998 (DE) ..... 198 50 202

(51) Int. Cl.[7] ..... H01H 33/66

(52) U.S. Cl. ..... 218/118; 218/139; 218/154; 218/155

(58) Field of Search ..... 218/118, 120, 218/123–126, 139–140, 153–154

(56) References Cited

U.S. PATENT DOCUMENTS 3,941,959 A * 3/1976 Kohler ..... 218/140
4,855,546 A * 8/1989 Leisch ..... 218/140

FOREIGN PATENT DOCUMENTS

| | | |
|---|---|---|
| DE | 35 44 972 A1 | 12/1985 |
| DE | 41 33 091 A1 | 9/1991 |
| DE | 42 26 772 A1 | 8/1992 |
| EP | 0 750 328 A1 | 12/1996 |

OTHER PUBLICATIONS

Katalog, Siemens HG Nov. 21, 1997, Vakkumschutze 3TL6, Seite 3/3.

* cited by examiner

*Primary Examiner*—Lincoln Donovan
*Assistant Examiner*—Marina Fishman
(74) *Attorney, Agent, or Firm*—Morrison & Foerster LLP

(57) ABSTRACT

The invention relates to switchgear assemblies having switching devices arranged in housings whose contact bolts can be deflected in a straight line and can be controlled by a magnetic drive device and are guided axially and radially by means of concentrically arranged slotted guides. The housings are formed by mutually opposite pole shells, and the slotted guides are each provided by rotating guides mounted at one end. The rotating guides each have a trapezoidal lever contour and are equipped with guide pins which extend outward and are mounted such that they can rotate in guide recesses in the mutually opposite pole shells. The rotating guides are each provided with a U-shaped bolt bearing in which a guide bolt is mounted. Switchgear assemblies such as this are used in the field of electrical power supply and distribution.

2 Claims, 2 Drawing Sheets

SWITCHGEAR WITH SWITCHING DEVICES ARRANGED IN HOUSINGS

This application claims priority to International Application No. PCT/DE99/03308 which was published in the German language on Oct. 12, 1999.

TECHNICAL FIELD OF THE INVENTION

The invention relates to switchgear assemblies having switching devices arranged in housings, and in particular, to switchgear assemblies having switching devices arranged in housings, with vacuum contactors, whose contact bolts can be deflected in a straight line and can be controlled by a magnetic drive device and are guided axially and radially by means of concentrically arranged slotted guides.

BACKGROUND OF THE INVENTION

Swithgear assemblies re known inter alia from the document "Siemens HG 11.21, 1997, Vakuumschütze 3TL6, page 3/3".

The axially moveable contact bolt has a conical extension at its free end, which is mounted in a slotted guide within the integral rocker, which can be deflected radially. The moveable contact bolt is thus protected against the influence of transverse forces in the voltage range up to 12 kV.

BRIEF DESCRIPTION OF THE DRAWINGS

The invention will be explained in more detail by means of an exemplary embodiment which is illustrated in two figures, in which.

DETAILED DESCRIPTION OF THE INVENTION

The invention improves considerably the guidance and bearing of the moveable contact bolts and also to protects them bolts against transverse forces which occur in the voltage range up to 24 kV.

According to the invention, this is achieved by, but not limited to, the following features:

the housings are formed by mutually opposite pole shells, the slotted guides are each provided by rotating guides mounted at one end, the rotating guides each have a trapezoidal lever contour, the rotating guides are equipped, in the broad region transverse with respect to their longitudinal axis at the free ends, with guide pins which extend outward and are mounted such that they can rotate in guide recesses in the mutually opposite pole shells, the rotating guides are each provided, in the narrow region parallel to their longitudinal axis at the free ends, with a U-shaped bolt bearing which is open outward, and a guide bolt which engages in a force-fitting manner in the contact bolt which can be deflected in a straight line is mounted in the bolt bearing.

The use of rotating guides which are mounted such that they can rotate within the opposite pole shells separates the guidance and bearing of the contact bolts from their axial contact deflection. Transverse forces which occur are absorbed by the rotating guides and can thus no longer act on the drive itself. The number of interruption switching operations, and hence the life of the switching devices, are thus considerably increased, even in the 24 kV voltage range.

One advantageous refinement of the invention provides the following feature:

the rotating guides are each provided by a plastic injection-molded part.

Consequently, both the conditions for an adequate withstand voltage and the conditions for mechanical loading are satisfied cost-effectively in comparison to the known solution.

Figure 1:
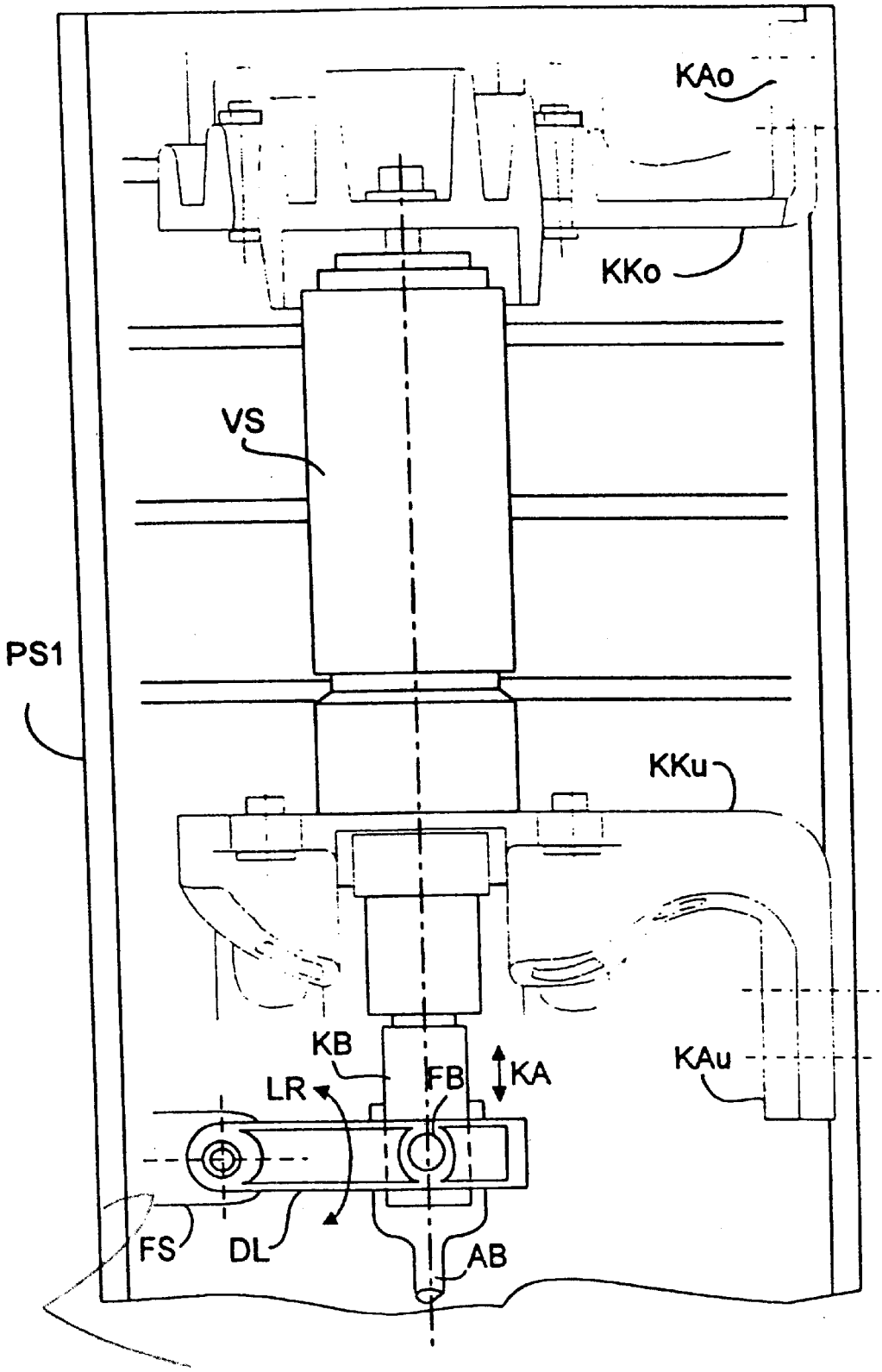
FIG. 1 shows the switching device in the installed state between the pole shells, as a side view.
Figure 2:
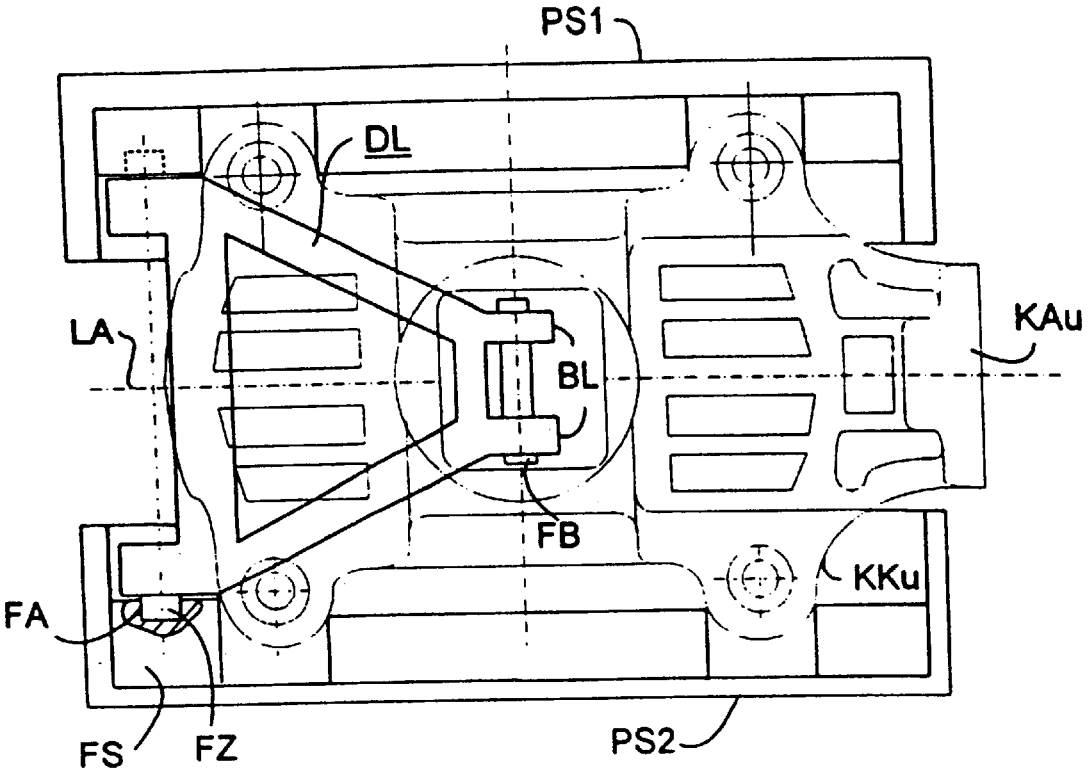
FIG. 2 shows the arrangement of the rotating guide between the pole shells underneath the lower heat sink.

The invention will be explained in more detail by means of an exemplary embodiment which is illustrated in two figures, in which:

FIG. 1 shows the switching device in the installed state between the pole shells, as a side view, and FIG. 2 shows the arrangement of the rotating guide between the pole shells underneath the lower heat sink.

FIG. 1 shows the switching device VS—in the form of a vacuum contactor—between the two pole shells PS1, PS2 (FIG. 2), with the pole shell PS2 (FIG. 2) which conceals the view in FIG. 1 being omitted to assist clarity. The upper and lower heat sinks KKo, Kku and their upper and lower contact connections Kao, Kau, are illustrated only indicatively.

The switching device VS includes the contact bolt KB, which is subject to an axial contact deflection KA in the direction of the arrow in the switching state from the drive bolt AB of a drive device, which is not illustrated. The contact bolt and the drive bolt AB are coupled in a force-fitting manner, with respect to any transverse forces that act, via the guide bolt FB to the rotating guide DL. The rotating guide DL is mounted such that it can rotate in the region of the guide webs—only the guide web FS of the first pole shell PS1 can be seen—and, in the switching state, is subject to radial guide rotation LR in the direction of the arrow.

FIG. 2 shows the two pole shells PS1, PS2, which are arranged with mirror-image symmetry and are each equipped with the guide web FS—only the guide web FS of the second pole shell PS2 is annotated. The mutually opposite guide webs FS each have the guide recess FA in which the guide pins FZ of the trapezoidal rotary guide DL are mounted. In the narrow end region, the trapezoidal rotating guide DL includes the U-shaped bolt bearing BL, which holds the guide bolt FB. It can also be seen that the longitudinal axis of the trapezoidal rotating guide DL is arranged identically to the longitudinal axis of the lower heat sink KKu which is illustrated indicatively, and the rotating guide DL is arranged underneath the lower heat sink KKu. The lateral guidance and centering of the contact bolt KB—as can be seen in FIG. 1—means that the opposite lower contact connection KAu is freely accessible for electrical cable connection.

What is claimed is:

1. A switchgear assembly having switching devices arranged in housings, including contact bolts configured to be deflected in a straight line, controllable by a magnetic drive device and guided axially and radially by concentrically arranged slotted guides, wherein the housings are formed by mutually opposite pole shells, the slotted guides are each provided by rotating guides and are mounted, the rotating guides each have a trapezoidal lever contour, the rotating guides are equipped, in a broad region transverse with respect to their longitudinal axis at the free ends, with guide pins which extend outward, lie in a plane defined by the trapezoidal lever contour are mounted-so as to rotate in guide recesses in the mutually opposite pole shells, the rotating guides are each provided, in a narrow region parallel to their longitudinal axis at the free ends, with a U-shaped bolt bearing which is open outward, and a guide bolt, which engages in a force-fitting manner in one of the contact bolts, is mounted in the bolt bearing.

2. The switchgear assembly as claimed in claim 1, wherein the rotating guides are each provided by a plastic injection-molded part.

* * * * *